United States Patent [19]

Durham et al.

[11] Patent Number: 4,572,501

[45] Date of Patent: Feb. 25, 1986

[54] EXERCISE DEVICE FOR ATTACHMENT TO A WHEELCHAIR

[76] Inventors: Claudia Durham, 778 Westover Dr.; Jeffrey E. Hopkins, 78 Fairfield Dr., both of, Danville, Va. 24541

[21] Appl. No.: 510,323

[22] Filed: Jul. 1, 1983

[51] Int. Cl.[4] ..... A63B 21/00; B62M 1/14

[52] U.S. Cl. ..... 272/73; 280/242 WC; 128/25 R

[58] Field of Search ..... 128/25 R; 272/73, 69, 272/93; 280/232, 233, 235, 242 WC, 289 WC; 297/DIG. 4; 5/81 R, 84

[56] References Cited

U.S. PATENT DOCUMENTS

| | | | |
|---|---|---|---|
| 2,630,332 | 3/1953 | Pettijohn | 280/233 |
| 3,122,395 | 2/1964 | Offner | 297/DIG. 4 |
| 3,381,973 | 5/1968 | Carr | 280/242 WC |
| 3,709,197 | 1/1973 | Moseley | 272/69 |
| 3,999,778 | 12/1976 | Markiel | 280/289 WC |
| 4,285,515 | 8/1981 | Gezari | 272/73 |
| 4,402,502 | 9/1983 | Peters | 128/25 R |

FOREIGN PATENT DOCUMENTS

| | | | |
|---|---|---|---|
| 1040907 | 10/1953 | France | 128/25 R |

*Primary Examiner*—Richard J. Apley

*Assistant Examiner*—S. R. Crow

*Attorney, Agent, or Firm*—Charles R. Rhodes; Judith E. Garmon

[57] ABSTRACT

An improved exercise device of the type attached to wheelchairs includes a frame having vertical and horizontal portions which support operatively connected, rotating handlebars and foot pedals for imparting movement to the arms and legs of a patient. The weight and height/length dimensions of the device are balanced with those dimensions of standard wheelchairs to create stability. The device further includes means for rendering the guide wheels of the chair stationary, and an improved lift mechanism for lifting or lowering the front wheels of the chair off/on the floor so that the device can be utilized in a stationary position or to drive the chair. The lift mechanism includes an externally threaded rod operatively mounted in an internally threaded shaft. A handle is attached to the upper end of the rod and a swivel-mounted rotation wheel or caster is mounted to the opposite end. Rotation of the handle and rod moves the caster into engagement with the floor and lifts the drive wheels of the exercise device off the floor thereby rendering the device and chair stationary.

5 Claims, 4 Drawing Figures

EXERCISE DEVICE FOR ATTACHMENT TO A WHEELCHAIR

BACKGROUND AND SUMMARY OF THE INVENTION

Physical therapy devices for treatment of wheelchair or paralytic patients are described in U.S. Pat. Nos. 3,423,086 and 4,222,376. The latter patent discloses a handlebar and foot pedal arrangement for cooperative movement of the legs and arms of patients seated in a stationary chair adjacent and attached to the frame of the apparatus. U.S. Pat. No. 3,423,086 to Moore is a similar apparatus for attachment to a wheelchair and for use by a patient who has some use of his legs. This device includes foot pedals only and has no means for exercising the arms, although stationary handles 39 for guiding the chair are shown. If the patient's legs are paralyzed, the Moore device is useless, even if the patient has full use of his arms. When pedestal 33 of the Moore patent is supporting front wheel 10, the attached wheelchair will be prevented from moving. However, when the pedestal is removed, wheel 10 rests on the same surface as wheels 59 of the chair, and by action of the pedals, wheel 10 will propel the chair.

A further problem with the device of the Moore patent is the fact that even if a patient has use of his arms, he cannot reach the pedestal 33 to engage or disengage the wheel 10. Additionally, an attendant would have great difficulty, more likely an impossibility, of adjusting the pedestal without removing the patient from the chair or disengaging the apparatus from the wheelchair. The weight of the patient, the chair and the apparatus would make such an adjustment nearly impossible.

With the Moore patent and others in the prior art, there is no means for stabilizing the patient as he is exercised. There is nothing associated with the exercise device to aid in preventing the patient from falling forward out of the chair. This becomes important when the patient who is severely disabled cannot be strapped into the wheelchair during exercise.

The present invention is directed to a device which may either be mobile or stationary, and wherein the device may be utilized to mobilize the wheelchair even if the patient's legs are paralyzed, as long as his arms may be used. There is also provided a lift mechanism for selectively engaging or disengaging the drive wheels of the apparatus with the ground, floor, or other support surface to use as a stationary exercise device or to propel the wheelchair. A vertical support column also helps to stabilize the patient and prevent falling.

In general, the device includes a pair of drive wheels mounted on an axle. Sprockets on the axle support a first chain which connects the drive wheels to a set of handle bars. A second chain connects the drive wheels to a set of foot pedals. So arranged, movement of the drive wheels may be initiated by either the handle bars or the foot pedals, or both. Also movement of either the foot pedals or the handle bars cause the other to rotate.

The lift mechanism includes a screw-type jack assembly mounted adjacent the rear end of device and the drive wheels for manually lifting the drive wheels to an inoperative position. Because it is a threaded, screw-type mechanism that is easily turned in its shaft, the patient or attendant can operate the lift with little exertion while the patient remains in the chair.

The frame of the exercise device also includes a vertical portion or column which, when attached to the wheelchair, is positioned in relationship to the patient such that it will prevent the patient from falling forward out of the chair. Straps on the foot pedals retain the feet of patients who have no use of their legs.

It is, therefore, an object of the present invention to provide an improved apparatus, which may be selectively stationary or mobile, for exercising the extremities of patients in wheelchairs. It is a further objective to provide a means for the patient or attendant to easily disengage the drive wheels of the mechanism while the patient remains in the wheelchair.

Other and further objects of the invention will become apparent as the following detailed description is studied in conjunction with the accompanying drawings of which:

DETAILED DESCRIPTION OF A PREFERRED EMBODIMENT

Figure 1:
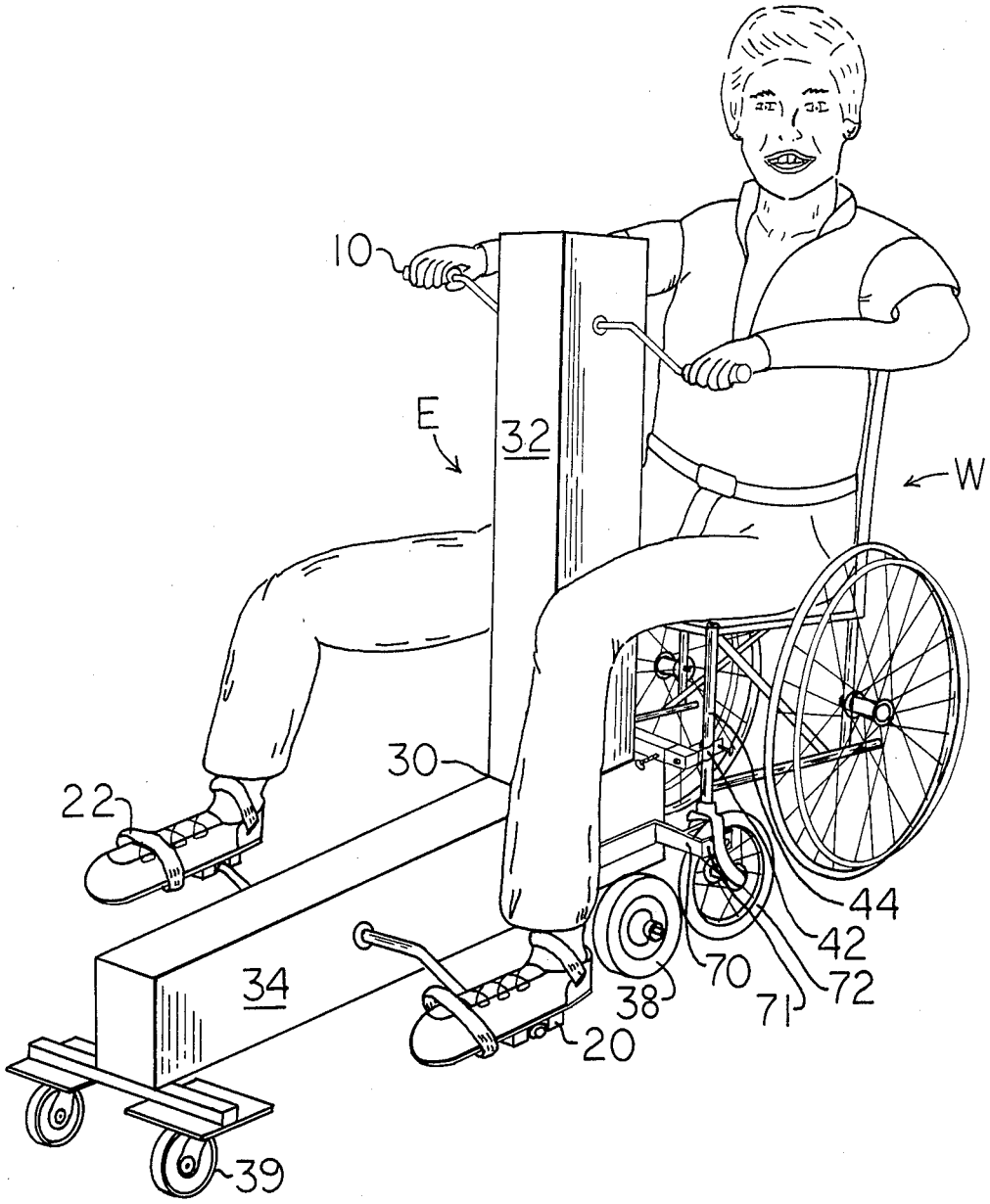
FIG. 1 is a perspective view of the present invention engaged to a wheelchair.

Looking at FIG. 1 the exercise device E is shown as attached to a wheelchair W, with patient seated therein. The operation of the handlebars 10 and foot pedals 20 is such that if a patient has healthy arms and rotates the handlebars, the movement is imparted to the legs by the resulting rotation of the foot pedals. The patient's feet may be strapped to the pedals by straps 22 if necessary to retain them. Conversely, if the patient has healthy legs, the rotational movement of the pedals is imparted to the arms.

Figure 2:
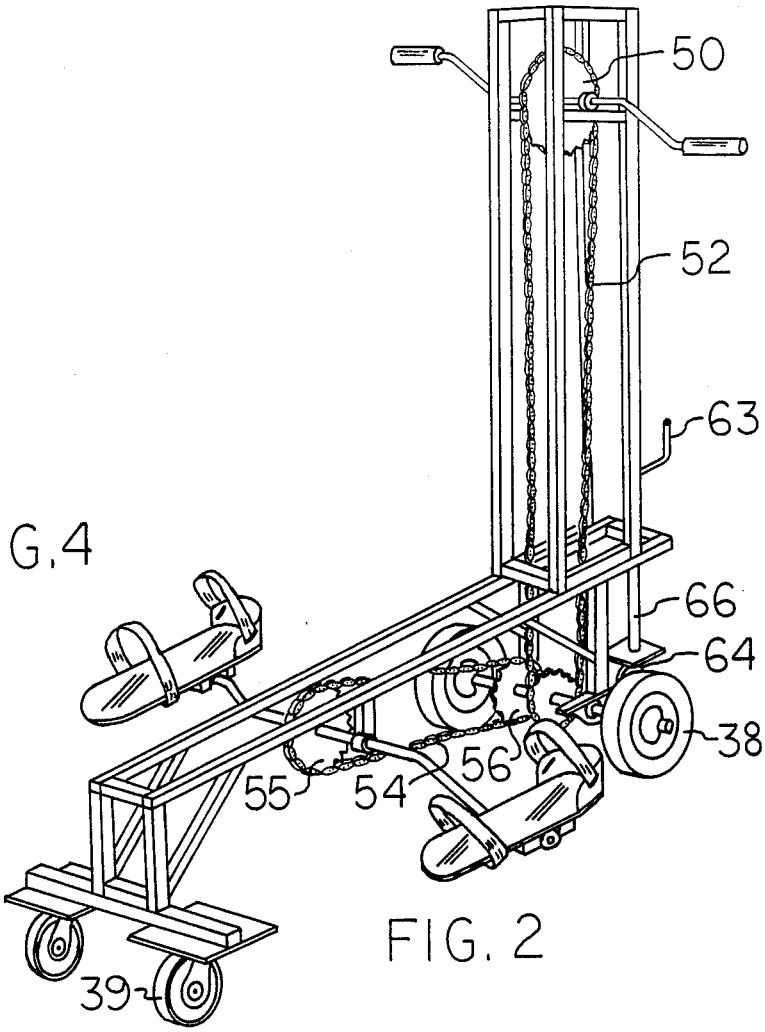
FIG. 2 is a perspective view illustrating the frame and inner mechanism of the exercise device with the housing removed.

The exercise device E has the primary mechanical parts safely contained in an L-shaped housing 30 which has a vertical portion 32 and a horizontal portion 34. The housing 30 is preferably formed from a metal such as stainless steel or aluminum, but it is contemplated that some of the rigid, highly strengthened plastic substances might be utilized. The handle bars 10 are mounted exteriorly of the housing, as are the pedals 20. The pedals 20 are preferably elongated to support the major portion of the patient's feet and include the aforementioned straps 22 thereon. The pedals are operatively connected to the drive wheels 38 of the exercise device as shown in FIG. 2.

Figure 3:
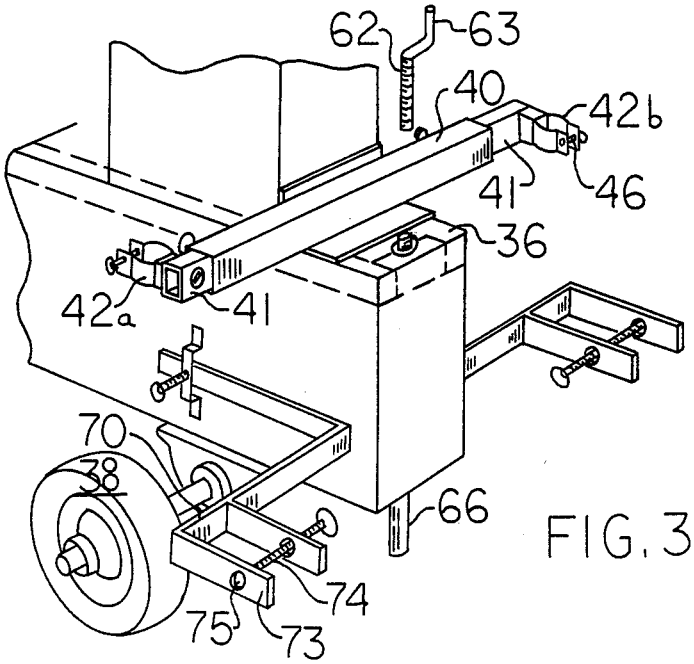
FIG. 3 is a detailed perspective view of the rearward end of the exercise device.

At the juncture of the vertical 32 and horizontal 34 portions of the housing, on ledge 36 is a crossbar 40 having a bracket assembly 42 on each end. The brackets 42 engage the tubular frame members 44 of the wheelchair and retain the members 44 therein by means of set screws 46. Thus the exercise apparatus is easily and quickly attached to the wheelchair. The crossbar 40 is a telescoping mechanism whereby segments 41 are slidably mounted in the bar 40 so that brackets 42 can be reversed as shown by FIG. 3. If it is desired to position the exerciser 10 as close as possible to the chair to accomodate persons having shorter legs, the brackets 42 should be turned away from the wheelchair as shown at **42*a*. To move the device away from the chair the brackets are both positioned as at 42*b* (also as shown in FIG. 1**).

When the device is joined to the wheelchair as shown in FIG. 1, the vertical portion of the housing is positioned substantially between the legs of the patient, with the patient's feet retained in the pedals 20 which are mounted approximately at the midportion of the horizontal housing 34 by means of a shaft 35 (FIG. 2) which connects the pedals. A pair of rotation wheels or casters 39 are mounted forward of the pedals 20 to support the leading end of the housing.

The vertical portion 32, as shown in FIG. 1, is positioned between the patient's legs, relatively close to the seat of the wheelchair. So arranged, the vertical 32 provides some support to the patient should he begin to fall forwardly out of the chair or should he begin to lean to one side or the other.

The operative mechanisms of the handlebars and pedals are shown in FIG. 2 and include a combination of sprockets and chains.

The handle bars 10 are connected to each other by a first shaft 11 which extends through the vertical portion of the frame. A second shaft 35 connects the foot pedals. A first sprocket wheel 50 is mounted on first shaft 11, and a second sprocket wheel 55 is mounted on shaft 35. In an alternate embodiment which is not shown, a first sprocket chain means can connect the first and second wheels 50,51. In the preferred embodiment shown in FIG. 2, however, the axle 37 which connects drive wheels 38 includes third and fourth sprocket wheels 56,57, for connection to both the foot pedals and handle bars. A chain means 52 connects the first and third sprocket wheels 50 and 56. A second chain 54 connects second and fourth sprocket wheels 55 and 57. Thus, the rotation of either the foot pedals or handle bars will activate drive wheels 38.

Figure 4:
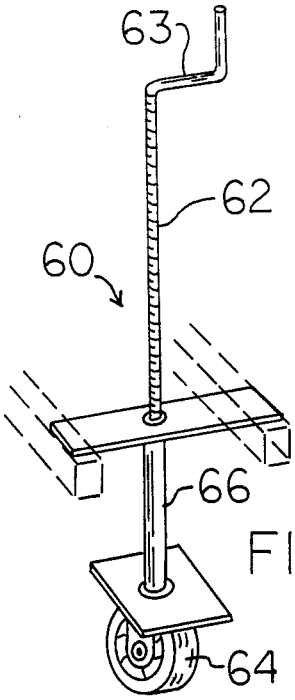
FIG. 4 is a detailed perspective view of the lift mechanism apart from the housing.

The improved lift mechanism 60 is installed in the horizontal portion of the housing, closely adjacent the drive wheels 38, for the purpose of lifting the drive wheels 38 off the surface of the floor to render the apparatus and wheelchair incapable of movement. The detailed view of the lift 60, shown in FIG. 4, reveals an externally threaded rod 62 having a handle 63 on the upper end, and a rotation wheel 64 swivelly mounted to the lower end thereof. The rod 62 is mounted in an internally threaded shaft 66. As the handle 63 is turned, the rod is threaded inwardly or outwardly of the shaft 66. When threaded inwardly of the shaft, the rod will urge the wheel 64 into engagement with the ground floor, or other support surface and lift the drive wheels 38 off the floor.

When the drive wheels are disengaged from the floor, the patient may exercise without moving the wheelchair and exercise device around the room. Both are stationary. The opposite is true when the lift 60 is activated to disengage the rotation wheel 64 from the floor and engage drive wheels 38. The wheelchair and device are then mobile and capable of movement responsive to turning of either the foot pedals or handle bars.

Because of the leverage provided by the threaded rod 62, a patient or attendant may activate or deactivate the drive wheels 38 with little effort. There is no necessity for removing the patient from the wheelchair before making the adjustment to the drive wheels.

The rod 62 and shaft 66 are positioned in the vertical housing portion with handle 63 extending through the top surface 33 for easy access by the patient. If the patient has use of the arms, the handle is easily reached from the wheelchair.

For aid in guiding the wheelchair when it is propelled by the exercise device, a pair of stabilizers 70 substantially prevent the side pivoting of the guide wheels or casters 72 on the wheelchair. The stabilizer comprises a U-shaped retainer 73, the lateral arms of which lie on either side of the support wheel 72, to prevent the wheel turning from side to side. A threaded rod 74 is inserted through an eyelet 75 and behind the axle to retain the axle therein.

Other and further modifications may be made without departing from the scope of the claims below.

What is claimed is:

1. An exercise device of the type which is removably attached to wheelchairs and used for exercising the limbs of disabled or partially paralyzed persons, said device comprising:

(a) a support frame having a horizontal portion and a vertical portion, both of said portions having height and length dimension balanced to the dimensions of the wheelchair for stability; said horizontal portion having a pair of guide wheels mounted on the leading end thereof, and a pair of drive wheels mounted a prescribed distance rearwardly from said guide wheels toward the wheelchair; said vertical portion extending substantially perpendicularly upwardly from a point near the rearward end of said horizontal portion adjacent the wheelchair when the device is connected to the chair;

(b) a pair of rotatable foot pedals mounted one on either side of said horizontal portion and a pair of rotatable handle bars mounted one on either side of said vertical portion;

(c) means for operatively connecting said foot pedals to said handle bars such that rotation of either the foot pedals or handle bars imparts rotation to the other of said foot pedals or handle bars;

(d) means for operatively connecting said foot pedals and handle bars to said drive wheels on said exercise device;

(e) means for connecting said exercise device to the wheelchair;

(f) means for converting said exercise device and the wheelchair from a stationary operative position with said drive wheels elevated from the ground, to a movable position with the drvie wheels engaging the ground wherein the device and the chair are mobilized by the person's use of the exercise device;

whereby the person confined to the wheelchair is positioned therein and when the exercise device is connected to the chair said vertical portion of said frame is substantially between the person's legs and adjacent the seat of the wheelchair such that said vertical portion aids in stabilizing the person during an exercise operation which may be mobile or stationary as related to simultaneous movement of the exercise device and the wheelchair.

2. An exercise device according to claim 1 wherein said means for operatively connecting said foot pedals and said handle bars comprises:

(a) a first shaft connecting said pair of handle bars and a second shaft connecting said foot pedals;

(b) a first sprocket wheel mounted on said first shaft, and a second sprocket wheel mounted on said second shaft;

(c) a first chain means having links to engage said sprocket wheels, said chain means being operatively connected to said first and second sprocket wheels, whereby rotation of said handle bars or foot pedals imparts rotation to the other of said handle bars or foot pedals.

3. An exercise device according to claim 2 wherein said means for connecting said drive wheels to said foot pedals and handle bars includes:

(a) an axle extending between said guide wheels, third and fourth sprocket wheels mounted in horizontally spaced relationship on said axle;

(b) said first chain means being operatively connected to said first and third sprocket wheels, and a second chain means operatively connecting said second and fourth sprocket wheels;

whereby rotation of either said handle bars or foot pedals will impart rotation to said drive wheels.

4. An exercise device according to claim 1 wherein said means for converting said exercise device to a selected one of said mobile or stationary operations includes a lift mechanism for selectively engaging or disengaging said drive wheels of said exercise device from the surface on which the apparatus sets, said lift mechanism including:

(a) an elongated, externally threaded rod having a handle on the upper end and a rotation wheel on the opposite, lower end;

(b) an elongated, internally threaded shaft for receiving said rod in a threaded, screw-type engagement therein having open ends such that said handle extends above said shaft and said rotation wheel is mounted below said shaft;

(c) said shaft further being mounted on a portion of said apparatus frame, positioned substantially adjacent said drive wheels such that rotation of said threaded rod in one direction moves said rotation wheel into engagement with the surface on which said apparatus and wheelchair set, thereby lifting said drive wheels out of such surface engagement; and rotation of said rod in the opposite direction disengages said rotation wheel and engages said drive wheels.

5. An exercise device according to claim 1 and further including a means for stabilizing the front guide wheels of the wheelchair to prevent the guide wheels from pivoting in a side to side motion.

* * * * *